US006009557A

United States Patent [19]

Witta

[11] Patent Number: 6,009,557

[45] Date of Patent: Jan. 4, 2000

[54] VIDEO GAME CONTROL GLOVE

[76] Inventor: Jay D. Witta, 7139 Shady Oak Rd., Eden Prairie, Minn. 55344

[21] Appl. No.: 09/034,381

[22] Filed: Mar. 4, 1998

[51] Int. Cl.[7] ..... A41D 19/00

[52] U.S. Cl. ..... 2/159; 2/161.1; 2/163; 473/59; 473/458

[58] Field of Search ..... 2/20, 161.1, 159, 2/161.3, 163, 161.4, 161.8, DIG. 910; 473/1, 458, 464, 59

[56] References Cited

U.S. PATENT DOCUMENTS

| | | | |
|---|---|---|---|
| D. 280,053 | 8/1985 | Singer . | |
| D. 351,930 | 10/1994 | Snider et al. . | |
| 356,385 | 1/1887 | Waterhouse | 2/20 |
| 3,881,197 | 5/1975 | Andrew | 2/161.8 |
| 4,071,913 | 2/1978 | Rector | 2/20 |
| 4,519,097 | 5/1985 | Chappell, Jr. et al. . | |
| 4,751,747 | 6/1988 | Banks et al. . | |
| 4,864,659 | 9/1989 | Morris | 2/20 |
| 4,881,276 | 11/1989 | Swan | 2/161.1 |
| 4,894,866 | 1/1990 | Walker . | |
| 4,987,611 | 1/1991 | Maye . | |
| 5,511,247 | 4/1996 | Block . | |
| 5,528,772 | 6/1996 | Cheek | 2/161.1 |
| 5,661,853 | 9/1997 | Wilmot . | |
| 5,675,839 | 10/1997 | Gordon . | |
| 5,732,413 | 3/1998 | Williams | 2/169 |

*Primary Examiner*—Diana Oleksa
*Assistant Examiner*—Katherine Moran
*Attorney, Agent, or Firm*—Moore & Hansen

[57] ABSTRACT

A video game glove offers protection for the thumb and forefinger of the game player. The glove extends over these two digits, and includes reinforced areas on the front of the tip of the two digits. The remaining fingers of the hand are fully exposed, and the glove is attached with a VELCRO® or similar fastener for a secure fit. The glove is preferably made of LYCRA® or a related material. The protective forefinger pad and thumb pad are preferably made of ULTRASUEDE® or a similar material.

7 Claims, 2 Drawing Sheets

VIDEO GAME CONTROL GLOVE

BACKGROUND OF THE INVENTION

1. Technical Field

The present invention relates generally to gloves for protecting parts of the hand from injury, and in particular to gloves for protecting the thumb and forefinger during repeated playing of video or computer games that use socalled video game controllers.

2. Background Information

As video games played on computers and stand-alone electronic game centers that use television screens become increasingly popular, more and more people, representing a broadening cross section of society, are spending increasing amounts of time playing these games. As with other games of skill, proficiency increases as more time is spent practicing, and as proficiency increases, the player gets more satisfaction from playing the game.

However, a by-product of playing many video games for hours at a time is that the game controllers—the hand-held devices that respond to commands given by finger actuation of various buttons and related input means—frequently causes painful blisters and calcifications which are aggravated by repeated playing of the game. In other words, frequent use of the game can result in injuries which will only heal if the player stops playing the game. Obviously, this is not a popular option for the avid video game player.

Options exist for protection of the player's hands. Since the pertinent injuries result from repeated contact with control buttons on the game controller, particularly with the thumb and forefinger, tape may be wrapped around the appendages to offer protection from wear and tear. However, tape may be difficult to apply, and it doesn't look good. Worse, depending on how it is applied, the needed sensitivity of the particular fingers being protected may be lost, detracting from the player's success and enjoyment of the game.

Sports gloves intended for other activities, such as golf gloves and batting gloves (for baseball players) offer hand protection, but not necessarily the type of protection needed for video game players. For example, batting gloves may offer padding to areas of the hand that don't need it, and too much padding where it is needed, resulting in reduced agility and sensitivity, two factors that are important for the video game player. After protection, the most important function of a video game glove is flexibility. Thus, overly padded gloves can actually prove detrimental to a video game player. Golf gloves, generally made of leather, are supple and comfortable, and offer good protection, but can be prohibitively expensive. Furthermore, style is also a significant factor among video game players looking for a glove they would be willing to use, and golf gloves, at least in part because of the game with which they are associated, are generally not considered an appropriate fashion accessory for video game enthusiasts.

Other attempts have been made at providing a useful video game glove. U.S. Pat. No. 4,519,097, issued to Chappell, Jr. et al. on May 28, 1985, offers protection for the hand and lower fingers (close to the hand), and good ventilation. However, it does not protect the tips of the thumb and forefinger, areas that are subjected to repeated abrasive contact with game controller devices. U.S. Pat. No. Des. 280,053, issued to Singer on Aug. 13, 1985, discloses a video game glove that has reinforced, protective areas on the palm, fingertips, tip of the thumb, and most of the forefinger and third finger. It attaches to the hand with fastening means around the wrist. However, this glove offers very little ventilation, crucial to the comfort of the video game player. Further, the large amount of padding tends to interfere with the flexibility of the glove, adversely affecting the performance of the game player.

The video game control glove of the present invention overcomes difficulties described above and affords other features and advantages heretofore not available.

SUMMARY OF THE INVENTION

The video game glove of the present invention offers protection for the thumb and forefinger of the game player. The glove extends over these two digits, and includes reinforced areas on the front of the tip of the two digits. The remaining fingers of the hand are fully exposed, and the glove is attached with a VELCRO® hook and loop fastener or similar fastener for a secure fit. The glove is preferably made of LYCRA® spandex or a related material. The protective forefinger pad and thumb pad are preferably made of ULTRASUEDE® imitation leather or a similar material.

It is an object of this invention to provide a comfortable, flexible, durable, protective glove for use by video game players. It is therefore an object of the intention that the glove be well ventilated, while affording protection primarily to the thumb and forefinger, including preventing calcifying or blistering of the thumb and forefinger.

It is a further object of the invention to provide a glove that is colorful, and has a novel design, while maximizing functionality. It is a further object of the invention that it achieve its protective function while maintaining a high level of flexibility, to prevent interference with the performance of the person wearing the glove.

Other objects and advantages of the invention will become apparent from the following detailed description and from the appended drawings in which like numbers have been used to describe like parts throughout the several views.

DESCRIPTION OF THE PREFERRED EMBODIMENT

Figure 1:
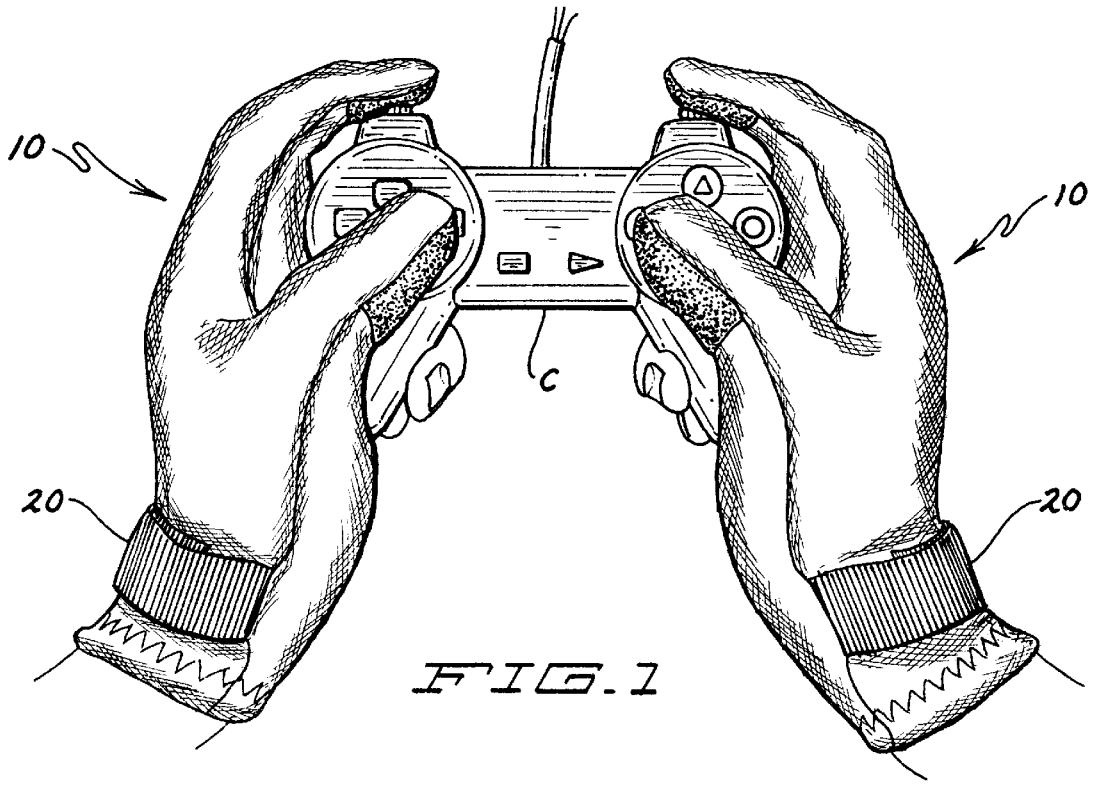
FIG. 1 is a plan view of two hands wearing the video game control gloves of the present invention, while manipulating the controls of a video game controller.
Figure 2:
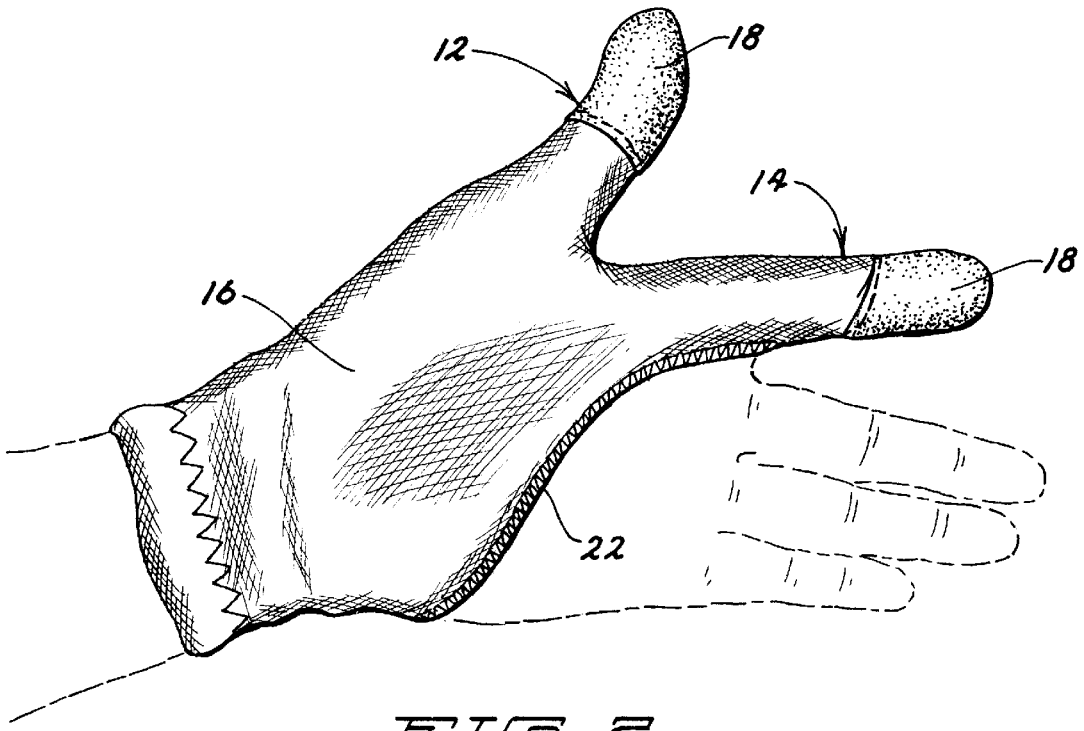
FIG. 2 is a front view of a video game control glove of the present invention for a left hand, being worn on a hand, shown in phantom.
Figure 3:
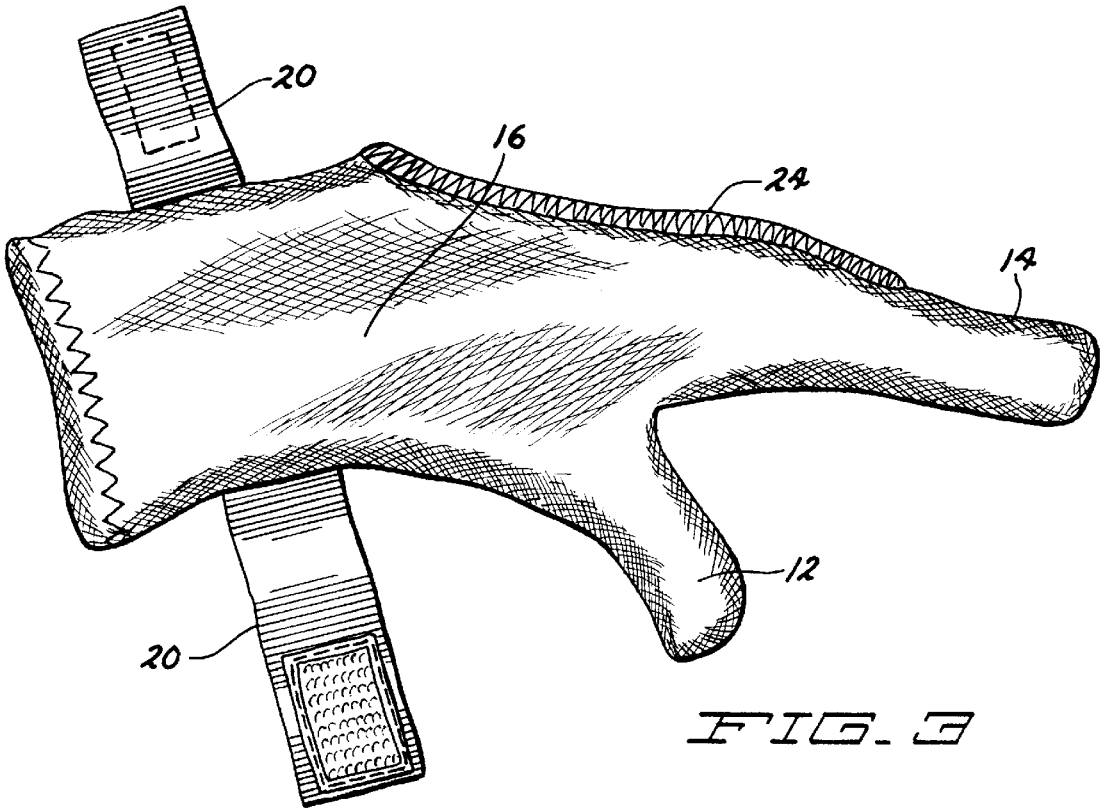
FIG. 3 is a rear plan view of a video game control glove of the present invention for a left hand.
Figure 4:
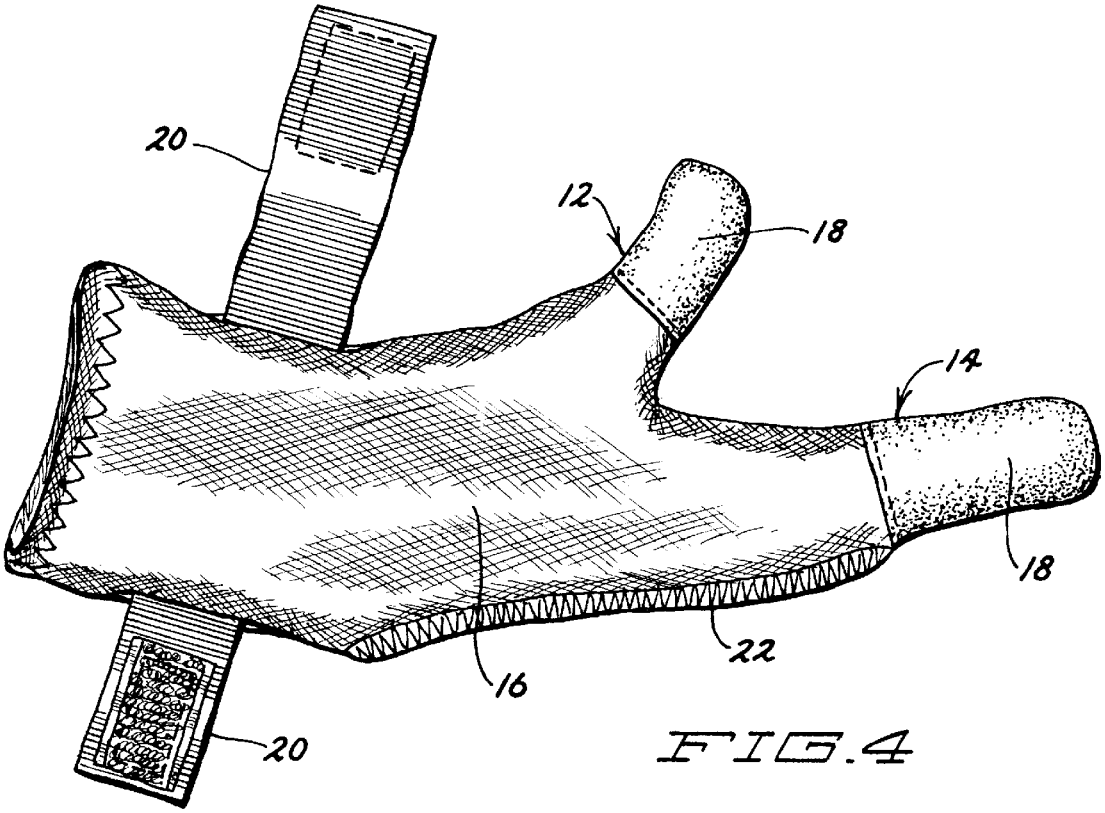
FIG. 4 is a front plan view of a video game control glove of the present invention for a left hand.

With reference to the drawings, and in particular to FIG. 1, the video game control glove is generally indicated by reference numeral 10. Video game glove 10 includes thumb portion 12, forefinger portion 14, and a lower hand portion 16. Video game control glove 10 is preferably used with a video game controller C as illustrated in FIG. 1. Various brands of video game controllers are similar to the one illustrated in FIG. 1, including SEGA® Genesis game controller, SONY® PlayStation game control, GRAVIS® GamePad game controller, and NINTENDO® Controller Pad. Particular button arrangements on each controller may vary slightly from one to the next, but the overall configuration of these controllers is quite similar. Further, some controllers are useable with games intended for personal computers, while others work with standalone video game systems.

The fabric used in video game glove 10 is preferably LYCRA® spandex or a similar material. LYCRA® spandex is flexible, permitting easy motion of the hand. The thumb portion 12 and forefinger portion 14 each include fingertip protection portions 18. Protection portions 18 are preferably made of ULTRASUEDE® imitation leather because of its ability to wear well yet maintain suppleness.

The video game glove 10 also includes a fastener 20, preferably made of a hook and loop type material, such as VELCRO®, hook and loop fastener to make it easy and convenient to put the glove on and take it off, and to keep the glove secure on the hand of the game player. Finally, a front seam 22 extends from forefinger portion 14 over the palm of the hand to the heal of the hand, and rear seam 24 extends from forefinger portion 14 over the back of the hand to the heal of the hand. The position of seams 22, 24 results in the little finger, ring finger, middle finger and most of the palm and back of the hand being exposed, for better ventilation and increased comfort.

While the preferred embodiments of the invention have been described, it should be understood that various changes, adaptations and modifications may be made therein without departing from the spirit of the invention and the scope of the appended claims.

What is claimed is:

1. A video game control glove, comprising:

a glove body having portions to cover only the thumb, forefinger and a part of the lower hand, each said thumb and forefinger portion having a front side and a rear side, and said lower hand portion adapted to fit over only a part of the user's palm and only a part of the back of the user's hand, thereby leaving at least a part of the user's palm exposed for further ventilation;

a fastening member for releasably fastening said glove body to the user's hand; and fingertip protection portions on said front sides of each of said thumb and finger portions.

2. The video game control glove defined in claim 1, wherein: said glove body is made of spandex.

3. The video game control glove defined in claim 1, wherein: said fastening member is made of a hook and loop fastening material.

4. The video game control glove defined in claim 1, wherein: said fingertip protection portions are made of imitation leather.

5. The video game control glove defined in claim 1, comprising: first and second finger portions, said first finger portion adapted to fit over the user's thumb, and said second finger portion adapted to fit over the user's forefinger; and first and second fingertip protection portions on said front sides of said first and second finger portions, respectively.

6. The video game control glove defined in claim 1, wherein:

said fingertip protection portions are made of leather.

7. The glove of claim 1 wherein said lower hand portion is defined in part by an edge extremity extending from the base of the forefinger to the heel of the hand over both the palm and the back of the hand, thereby exposing a portion of the palm and defining an opening through which the little finger, ring finger, and middle finger may extend.

* * * * *